US007388556B2

(12) United States Patent
Zimmerman

(10) Patent No.: US 7,388,556 B2
(45) Date of Patent: Jun. 17, 2008

(54) ANTENNA PROVIDING DOWNTILT AND PRESERVING HALF POWER BEAM WIDTH

(75) Inventor: Martin L. Zimmerman, Chicago, IL (US)

(73) Assignee: Andrew Corporation, Orland Park, IL (US)

( * ) Notice: Subject to any disclaimer, the term of this patent is extended or adjusted under 35 U.S.C. 154(b) by 219 days.

(21) Appl. No.: 11/141,830

(22) Filed: Jun. 1, 2005

(65) Prior Publication Data

US 2006/0279471 A1 Dec. 14, 2006

(51) Int. Cl.
*H01Q 19/00* (2006.01)

(52) U.S. Cl. ..... 343/833; 343/834; 343/792.5; 343/793

(58) Field of Classification Search ..... 343/700 MS, 343/793, 795, 797, 815, 792.5, 833, 834
See application file for complete search history.

(56) References Cited

U.S. PATENT DOCUMENTS

| | | | | |
|---|---|---|---|---|
| 3,491,361 | A * | 1/1970 | Campbell | 343/741 |
| 4,218,686 | A | 8/1980 | Blonder | |
| 4,301,457 | A | 11/1981 | Bogner | |
| 4,403,222 | A | 9/1983 | Bitter, Jr. et al. | |
| 4,583,098 | A | 4/1986 | Sikina, Jr. | |
| 5,220,335 | A * | 6/1993 | Huang | 343/700 MS |
| 5,497,164 | A * | 3/1996 | Croq | 343/700 MS |
| 6,104,348 | A | 8/2000 | Karlsson et al. | |
| 6,208,300 | B1 | 3/2001 | Johnson | |
| 6,310,585 | B1 | 10/2001 | Marino | |
| 6,326,922 | B1 * | 12/2001 | Hegendoerfer | 343/700 MS |
| 6,867,740 | B2 * | 3/2005 | Goodyear | 343/718 |
| 6,924,776 | B2 | 8/2005 | Le et al. | |
| 7,102,571 | B2 * | 9/2006 | McCarrick | 343/700 MS |
| 7,102,582 | B2 * | 9/2006 | Sato | 343/767 |
| 2005/0001778 | A1 | 1/2005 | Le et al. | |

FOREIGN PATENT DOCUMENTS

| | | |
|---|---|---|
| EP | 0 376 701 | 8/1994 |
| JP | 02260804 A | 10/1990 |
| KR | 2002-0004076 | 1/2002 |
| WO | WO 95/30256 | 11/1995 |
| WO | WO 02/23669 | 3/2002 |

* cited by examiner

*Primary Examiner*—Tan Ho
(74) *Attorney, Agent, or Firm*—Welsh & Katz, Ltd

(57) ABSTRACT

A panel antenna is provided having one or more radiating elements and a series of directors associated with each radiating element. Each series of directors is angled with respect to a direction of maximum radiation of the associated radiating element, in order to tilt the panel antenna beam. The directors may be dimensioned and/or arranged such that they couple weakly to radiation of a wavelength emitted by the associated radiating element. The directors may be dimensioned and/or arranged such that they are non-resonant at the wavelength emitted by the associated radiating element. The directors may be smaller than the length of an associated dipole radiating element.

35 Claims, 5 Drawing Sheets

Figure 3
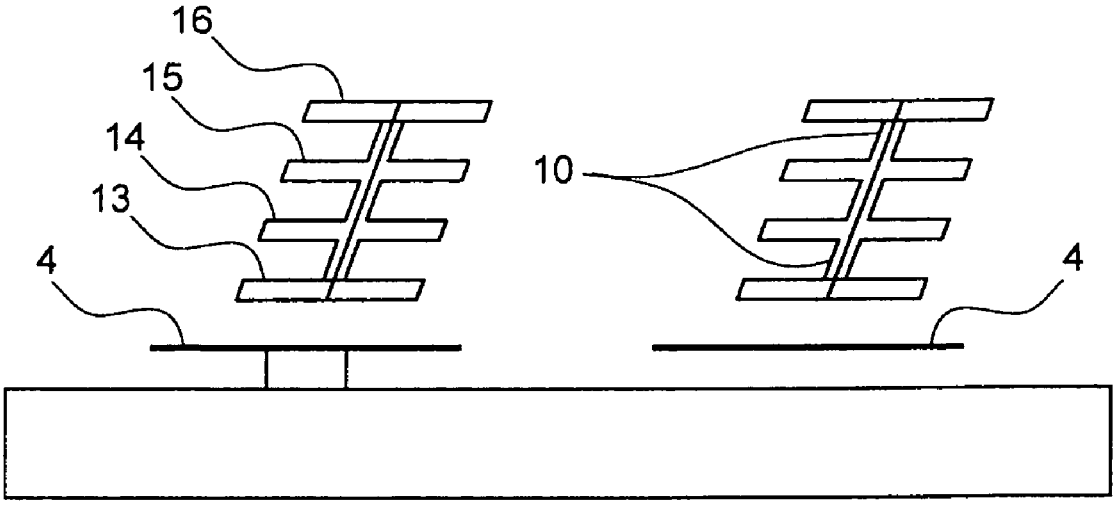
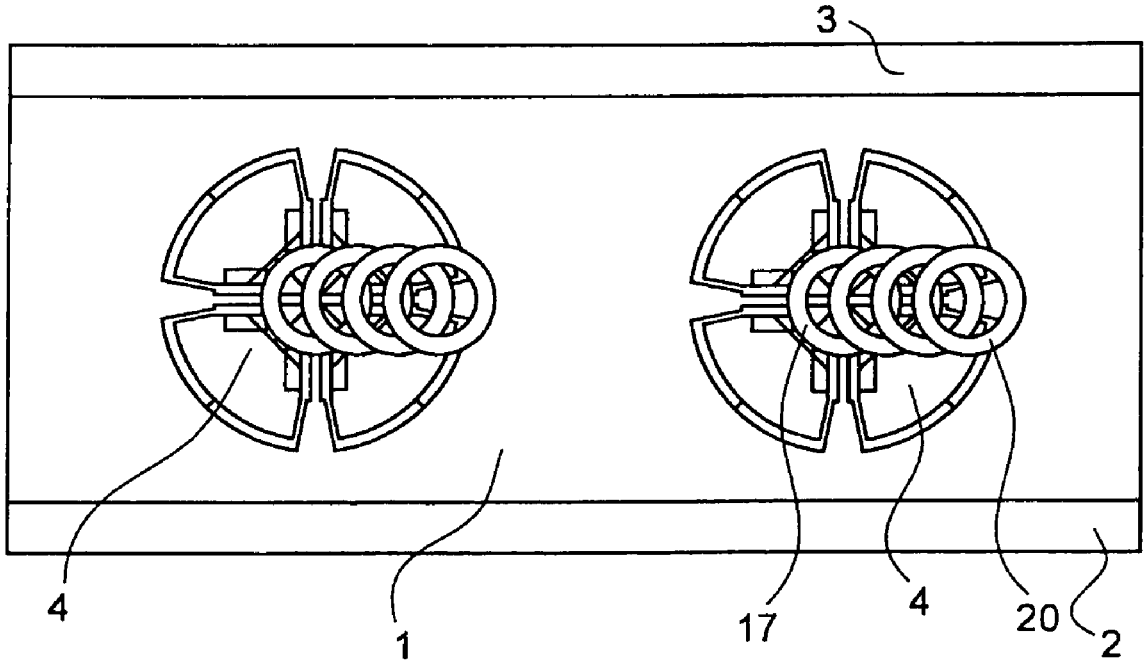
Figure 4

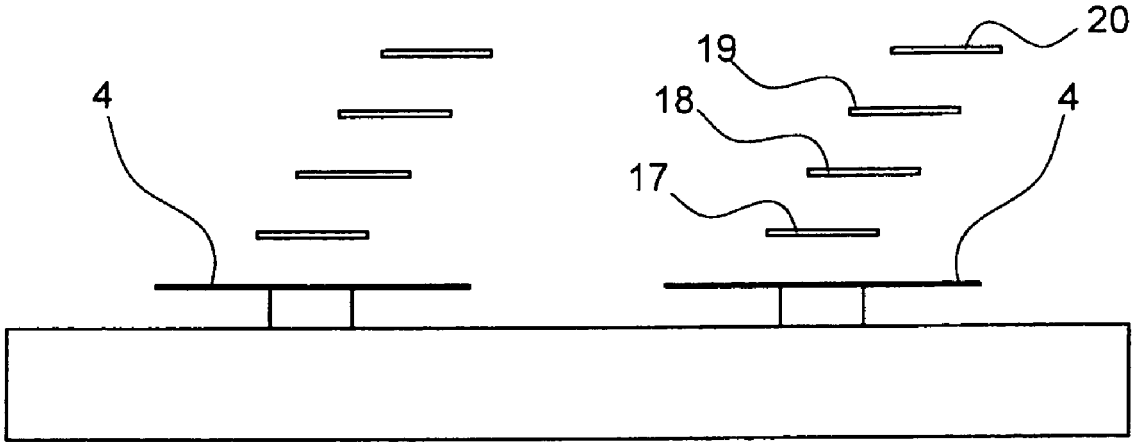
Figure 5
Figure 6
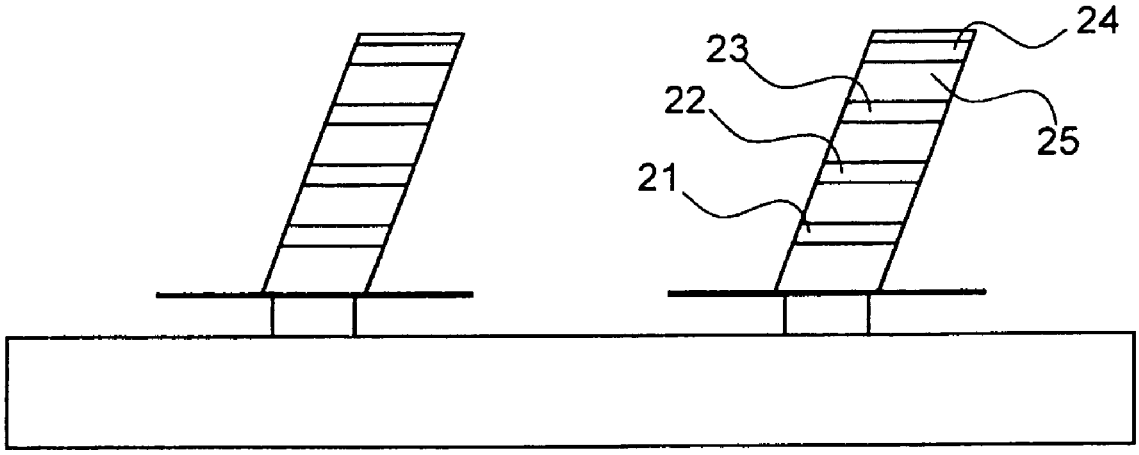

ANTENNA PROVIDING DOWNTILT AND PRESERVING HALF POWER BEAM WIDTH

FIELD OF THE INVENTION

The invention relates to antennas. In particular the invention relates to antennas for use in wireless communication networks, such as cellular telecommunications systems.

BACKGROUND OF THE INVENTION

Wireless communications networks may be divided into cells, with each base station antenna in the network servicing a cell. Base station antennas generally tilt their beams downwards, towards the mobile handsets carried by users and to minimise energy radiated above the horizon. However, the simplest antenna geometry places radiating elements in a plane parallel to a vertical reflecting ground plane. This causes energy to be radiated equally above and below the horizon.

Various methods of achieving downtilt of the antenna radiation pattern have been proposed. In an antenna array, downtilt may be adjusted by arrangement of phase relationships between radiating elements. Alternatively, the radiation pattern of each radiating element may be tilted, either by physically tilting the radiating element, or by use of parasitic elements.

In US 2005/0001778 the ground plane is divided into a number of "element trays" which are arranged in a staircase structure. Each tray is tilted to aim below the horizon. This leads to an increase in part quantity, cost, assembly time, weight and complexity.

JP 02260804 proposes a circular patch antenna with a pair of parasitic elements mounted above each circular patch. Each parasitic element is a circular patch of the same dimensions as the radiator. Thus, the parasitic elements are of a resonant dimension. The resultant direction of radiation passes through the centre of the parasitic elements. This system would result in a substantial decrease in half power beam width and is therefore not suitable for use in a panel antenna for wireless communications systems.

It would therefore be desirable to provide downtilt in a base station antenna with reduced cost and complexity.

EXEMPLARY EMBODIMENTS

According to one exemplary embodiment there is provided a panel antenna including:

a ground plane;

one or more radiating elements disposed above the ground plane; and a series of directors associated with each radiating element, each series of directors being dimensioned and/or arranged so as to couple weakly to radiation of a wavelength emitted by the associated radiating element, each series of directors including a plurality of directors disposed in a direction at a first angle to a direction of maximum radiation of the associated radiating element, such as to tilt a beam of the panel antenna.

According to another exemplary embodiment there is provided a panel antenna including:

a ground plane;

one or more radiating elements disposed above the ground plane; and a series of directors associated with each radiating element, each series of directors having an average dimension chosen such that the directors are not resonant at a wavelength emitted by the associated radiating element, each series of directors including a plurality of directors disposed in a direction at a first angle to a direction of maximum radiation of the associated radiating element, such as to tilt a beam of the panel antenna.

According to another exemplary embodiment there is provided a panel antenna including:

a ground plane;

one or more radiating elements disposed above the ground plane, each including a dipole; and a series of directors associated with each radiating element, each director having a dimension parallel to the length of the dipole that is less than the length of the dipole, each series of directors including a plurality of directors disposed in a direction at a first angle to a direction of maximum radiation of the associated radiating element, such as to tilt a beam of the panel antenna.

According to another exemplary embodiment there is provided a base station including an antenna as described in one of the above embodiments.

According to another exemplary embodiment there is provided a wireless communications network including a plurality of such base stations.

BRIEF DESCRIPTION OF THE DRAWINGS

The accompanying drawings which are incorporated in and constitute part of the specification, illustrate embodiments of the invention and, together with the general description of the invention given above, and the detailed description of embodiments given below, serve to explain the principles of the invention.

FIG. 3 is a side view of a panel antenna according to a second embodiment;

FIG. 4 is a top view of a panel antenna according to a third embodiment;

FIG. 5 is a side view of the antenna of FIG. 4;

FIG. 6 is a side view of a panel antenna according to a fourth embodiment;

DETAILED DESCRIPTION OF EMBODIMENTS OF THE INVENTION

The figures show embodiments of a panel antenna with a ground plane, radiating elements and directors. For clarity, the means for supporting the directors above the radiating elements are not shown. The directors could be supported by a simple framework, as will be understood by readers skilled in the art.

Figure 1:
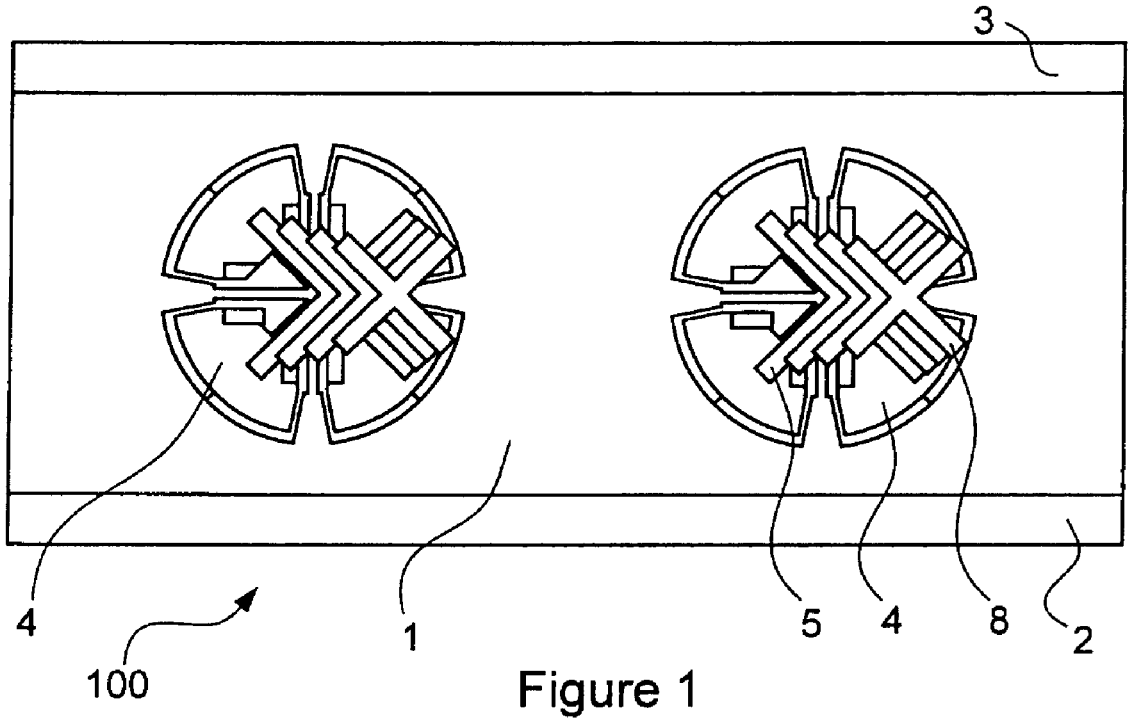
FIG. 1 is a top view of a panel antenna according to a first embodiment.
Figure 2:
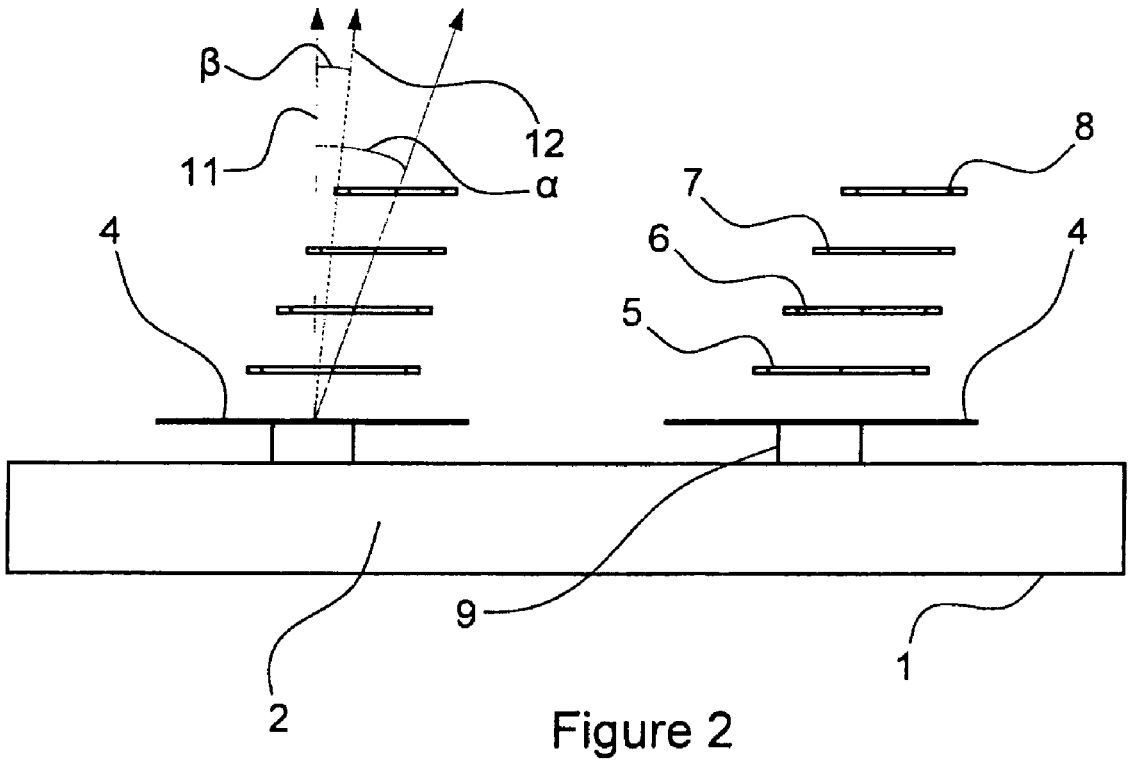
FIG. 2 is a side view of the antenna of FIG. 1.

FIGS. 1 and 2 show a panel antenna 100 according to a first embodiment. The antenna 100 includes a ground plane 1, having side walls 2 and 3. End walls may also be provided. Radiating elements 4 are mounted above the ground plane 1 on supports 9. The radiating elements shown are circular four-square radiators. However, various radiating elements may be used, including dipoles, crossed dipoles, dipole squares, four-square dipoles, annular rings, and patches.

Mounted above each radiating element is an associated series of directors. Each series of directors includes four directors 5-8. Preferably the number of directors in each series is between two and six, although other numbers of directors may be suitable. The directors shown are crossed-dipole directors. However, other forms of director may be used, such as annular rings, dipoles, bowtie crossed-dipoles and patches.

In the absence of directors, the direction of maximum radiation 11 (FIG. 2) of each radiating element is perpendicular to the ground plane 1. The directors are disposed at an angle a to that direction of maximum radiation. The resultant direction of maximum radiation 12 (that is the direction of maximum radiation of the element and its directors together) lies at a lesser angle $\beta$ to the direction of maximum radiation 11 of the radiating element alone. As discussed below, weak coupling between the radiating element 4 and the directors is desirable, and in a prototype with weak coupling, the ratio of $\alpha$ to $\beta$ was found to be about 4. In general, the weaker the coupling the higher this ratio will be, and the stronger the coupling the lower this ratio will be.

This ratio may also depend on the directivity of the radiating element. A more directive element may require a steeper director angle or a greater level of coupling to achieve the same downtilt.

The surface of each radiating element lies in a plane parallel to the ground plane 1, as seen in FIG. 2, and each director is disposed in a plane parallel to that of its associated radiating element. The directors could be disposed in planes angled with respect to the plane of the radiating element. However, it is difficult to tilt the directors in this way, without the lower edge of the lowermost director interfering with the radiating element and distorting performance of the radiating element.

In the embodiment of FIGS. 1 and 2, the directors are not of a uniform size. The lengths of the crossed-dipoles decrease with distance from the radiating element. The lengths of the dipoles may or may not decrease by a constant scaling factor.

In the subsequent drawings the same radiating elements 4 are used and so the same number is used.

FIG. 3 shows an embodiment similar to that of FIGS. 1 and 2. Here the directors 13-16 are all the same size. The directors 13-16 are formed from a single piece of material, such that they are joined by a supporting part 10. This could be achieved by extruding metal into a cross-shape, then machining the extrusion to remove unwanted material. This has the advantage that a simple structure supporting the first director 13 can support all directors above the radiating element.

FIGS. 4 and 5 show a panel antenna according to a second embodiment in which the directors are annular rings 17-20, with each annular ring being the same size.

FIG. 6 shows a fourth embodiment in which annular ring directors 21-24 are formed on a tube 25. the directors can be printed or etched onto a non-conductive flexible planar substrate, which is then rolled to form the tube 25. Alternatively, the directors could be printed or etched onto a non-conductive tubular substrate. The tube could be conical, if directors of varying diameters are to be used. This has the advantage that the directors can be supported simply by supporting the tube. The directors may also be made cheaply and easily by this method.

Figure 7:
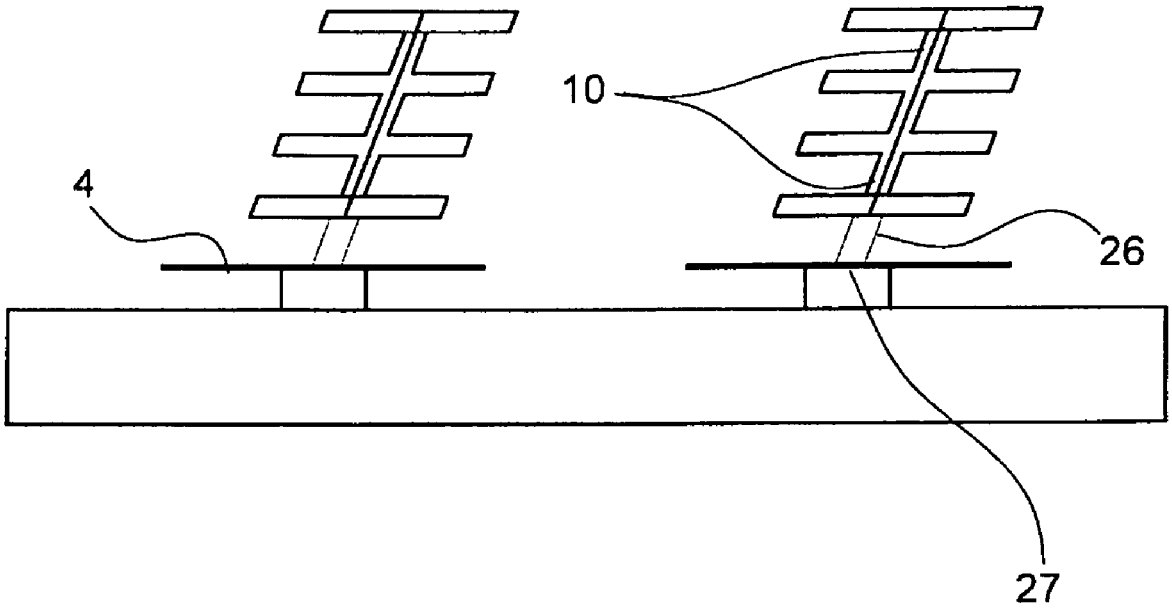
FIG. 7 is a side view of a panel antenna according to a fifth embodiment.

FIG. 7 shows a further embodiment similar to that of FIG. 3, in which each series of directors is held in place by support 26. The support 26 is pivoted about a point 27 in the plane of the radiating element. By pivoting the support 26 and the series of directors, some adjustment of downtilt is possible. The mechanism shown results in each directors being rotated out of a plane parallel to that of the radiating element. It would also be possible to create a sliding mechanism for each director, so that the angle of the directors is adjusted while each director stays in its plane. The mechanism could be adjusted manually or by means of a motor controlled remotely.

Figure 8:
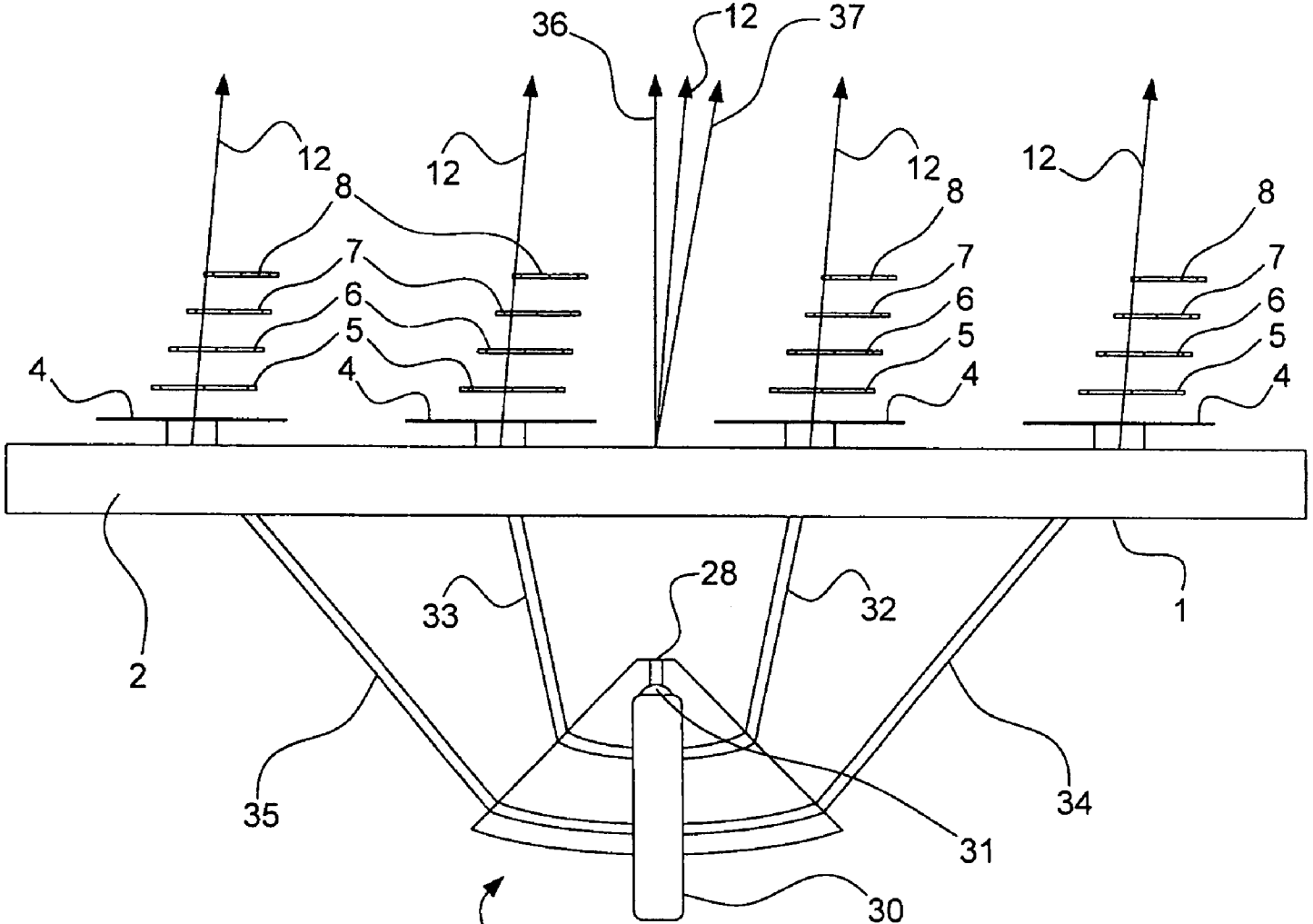
FIG. 8 is a side view of a panel antenna according to a sixth embodiment.

FIG. 8 shows another embodiment, in which the panel antenna has four radiating elements 4, each with an associated series of directors 5-8.

FIG. 8 also shows a simple feed network. A signal is supplied to the feed network at input 28. The signal is then split and phase shifts are imparted by a wiper-type differential phase shifter 29 (such as described in U.S. Pat. No. 6,850,130). This phase shifter includes a wiper arm 30, which rotates around a pivot 31. The wiper couples to the feedlines 32-35. The feedlines 32, 33 are formed from a single strip of conductive material, so that when the phase shifter is adjusted to impart a phase shift of $\Delta\omega$ on feedline 32, a phase shift of $-\Delta\omega$ is imparted to feedline 33. Feedlines 34, 35 are also formed from a single strip of conductive material and the wiper arm 30 and arcuate portions of feedlines 32-35 are arranged such that a phase shift three times larger is induced in the outer feedlines 34, 35 than the inner feedlines 32, 33. So in this example, phase shifts of $3\Delta\omega$ and $-3\Delta\omega$ are imparted to feedlines 34 and 35 respectively. Each of feedlines 32-35 is connected to a radiating element 4. By altering the phase of radiation emitted by each radiating element, it is possible to adjust the downtilt of the antenna beam.

The desired beam tilt range is between a minimum beam tilt 36 and a maximum beam tilt 37. Each radiating element and its directors are therefore arranged to provide a resultant direction of maximum radiation 12 at about the midpoint of the beam tilt range. The wiper arm 30 is then adjusted to move the beam tilt within the desired range.

Although this antenna has been described with reference to transmission, it will be understood that it is also capable of receiving signals.

It is desirable to achieve downtilt of the antenna beam, without affecting its azimuth half power beam width (HPBW). To achieve this, the directors must couple weakly to the radiation from the associated radiating element. Generally this means that the directors will be smaller than a resonant dimension at the relevant frequencies. Where the radiating element is a dipole or crossed dipole, the directors will have a major dimension that is smaller than the length of the dipole.

For example, a dipole typically resonates at a length of 0.5 wavelengths. In yagi-style antennas, directors with lengths of about 0.45 wavelengths may be used. For the purposes of the invention, a series of dipole or crossed-dipole directors preferably has a length of less than 0.4 wavelengths, more preferably around 0.35 wavelengths.

Annular rings resonate when the circumference of the ring is about one wavelength. Therefore, a series of annular ring directors preferably has an average circumference of less than 0.6 wavelengths, more preferably about 0.5 wavelengths.

The spacing between the radiating element and the first director and the spacing between adjacent directors is important for achieving improved Front/Back and Side/Back ratios. In a conventional yagi antenna, the directors may be spaced by about 0.1 to 0.25 wavelengths. For the purposes of this invention, the directors are preferably spaced by less than 0.15 wavelengths, more preferably by about 0.1 wavelengths.

Thus, the directors are smaller and closer together than in a conventional high-gain yagi antenna.

Preferably the angle of the directors is chosen such that the downtilt angle of the resultant element radiation pattern is about half the antenna downtilt range; the resultant element radiation pattern being the radiation pattern of the radiating element and its associated series of directors. Phase adjustments or other downtilt adjusting methods, such as those employed in WO 02/05383, are then used to adjust the downtilt around this median.

For example, in an antenna with a downtilt range of 2 to 12 degrees, the downtilt angle of the resultant element radiation pattern is preferably chosen to be about 7 degrees.

While the invention has been described with reference to dual-polarized antennas, it is equally applicable to single polarised antennas and circularly polarised antennas. Similarly, while the embodiments illustrated show an antenna with two radiating elements, the invention is equally applicable to panel antennas with any number of radiating elements.

While the present invention has been illustrated by the description of the embodiments thereof, and while the embodiments have been described in detail, it is not the intention of the Applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departure from the spirit or scope of the Applicant's general inventive concept.

The invention claimed is:

1. A panel antenna including:

a ground plane;

one or more radiating elements disposed above the ground plane; and a series of directors associated with each radiating element, each series of directors being dimensioned and/or arranged so as to couple weakly to radiation of a wavelength emitted by the associated radiating element, each series of directors including a plurality of directors disposed in a direction at a first angle to a direction of maximum radiation of the associated radiating element, such as to tilt a beam of the panel antenna.

2. A panel antenna as claimed in claim 1, wherein each director lies in a plane substantially parallel to a plane of its associated radiating element.

3. A panel antenna as claimed in claim 1, wherein the directors are dimensioned and arranged such that the first angle is greater than a second angle between the direction of maximum radiation of the associated radiating element and a direction of maximum radiation of that element and its associated directors.

4. A panel antenna as claimed in claim 3, wherein the directors are dimensioned and arranged such that the first angle is approximately four times the second angle.

5. A panel antenna as claimed in claim 1, wherein the first angle is between 0 and 45 degrees.

6. A panel antenna as claimed in claim 1, wherein the half power beam width (HPBW) of each radiating element and its associated series of directors is substantially the same as the HPBW of the radiating element alone.

7. A panel antenna as claimed in claim 1, wherein each radiating element is chosen from the group consisting of: dipoles, crossed-dipoles, dipole squares and patches.

8. A panel antenna as claimed in claim 7, wherein each director is chosen from the group consisting of: dipoles, crossed-dipoles, annular rings, and patches.

9. A panel antenna as claimed in claim 1, wherein each radiating element is a dual-polarised radiating element.

10. A panel antenna as claimed in claim 1, wherein each series of directors comprises between two and six directors.

11. A panel antenna as claimed in claim 10, wherein each series of directors comprises between two and four directors.

12. A panel antenna as claimed in claim 10, wherein each series of directors comprises four directors.

13. A panel antenna as claimed in claim 1, wherein the directors are dipoles, and the average length of the dipoles is less than 0.4 times the wavelength of radiation emitted by the radiating element.

14. A panel antenna as claimed in claim 13, wherein the average length of the dipoles is about 0.35 times the wavelength of radiation emitted by the radiating element.

15. A panel antenna as claimed in claim 1, wherein the directors are dipoles, and each series of directors is formed from a single piece of material.

16. A panel antenna as claimed in claim 15, wherein the single piece of material includes a central supporting part which connects to each dipole around its centre.

17. A panel antenna as claimed in claim 1, wherein the directors are annular rings and the average circumference of the annular rings is less than 0.6 times the wavelength of radiation emitted by the radiating element.

18. A panel antenna as claimed in claim 17, wherein the average circumference of the annular rings is about 0.5 times the wavelength of radiation emitted by the radiating element.

19. A panel antenna as claimed in claim 1, wherein the directors are annular rings and each series of directors is formed from conductive rings printed or etched onto a non-conductive substrate.

20. A panel antenna as claimed in claim 19, wherein the non-conductive substrate is tubular.

21. A panel antenna as claimed in claim 19, wherein the non-conductive substrate is planar and is formed into a tube after printing or etching of the conductive rings.

22. A panel antenna as claimed in claim 1, wherein the directors in each series are disposed in parallel planes, and the spacing between the planes is less than 0.15 times the wavelength of radiation emitted by the radiating element.

23. A panel antenna as claimed in claim 1, wherein the directors in each series are disposed in parallel planes, and the spacing between the planes is about 0.1 times the wavelength of radiation emitted by the radiating element.

24. A panel antenna as claimed in claim 1, wherein the directors in each series of directors decrease in size with distance from the associated radiating element.

25. A panel antenna as claimed in claim 1, wherein the directors in each series of directors are all of the same dimensions.

26. A panel antenna as claimed in claim 1, including a plurality of radiating elements.

27. A panel antenna as claimed in claim 26, wherein the radiating elements are arranged in an antenna array.

28. A panel antenna as claimed in claim 27, wherein each radiating element and its associated series of directors are arranged such that the direction of maximum radiation of that element and its associated directors is at approximately the midpoint of a downtilt range of the antenna array.

29. A panel antenna according to claim 26, further including a feed network for feeding signals to the radiating elements, the feed network including means for adjusting the downtilt of the antenna within a desired downtilt range, the radiating elements and directors being arranged such that the downtilt of each radiating element and its associated directors is substantially at the midpoint of the downtilt range.

30. A panel antenna as claimed in claim 1, further including means for increasing or decreasing the first angle so as to adjust the tilt of the beam of the panel antenna.

31. A base station including an antenna according to claim 1.

32. A base station as claimed in claim 31, wherein the ground plane and the radiating elements are disposed substantially vertically, and the directors are disposed at an angle below the horizon.

33. A wireless communications network including a plurality of base stations according to claim 31.

34. A panel antenna including:

a ground plane;

one or more radiating elements disposed above the ground plane; and a series of directors associated with each radiating element, each series of directors having an average dimension chosen such that the directors are not resonant at a wavelength emitted by the associated radiating element, each series of directors including a plurality of directors disposed in a direction at a first angle to a direction of maximum radiation of the associated radiating element, such as to tilt a beam of the panel antenna.

35. A panel antenna including:

a ground plane;

one or more radiating elements disposed above the ground plane, each including a dipole; and a series of directors associated with each radiating element, each director having a dimension parallel to the length of the dipole that is less than the length of the dipole, each series of directors including a plurality of directors disposed in a direction at a first angle to a direction of maximum radiation of the associated radiating element, such as to tilt a beam of the panel antenna.

* * * * *